US010306971B2

(12) United States Patent
Zhang

(10) Patent No.: US 10,306,971 B2
(45) Date of Patent: Jun. 4, 2019

(54) CONVERTIBLE BULLET-PROOF BACKPACK

(71) Applicant: Wei Zhang, Calgary (CA)

(72) Inventor: Wei Zhang, Calgary (CA)

( * ) Notice: Subject to any disclaimer, the term of this patent is extended or adjusted under 35 U.S.C. 154(b) by 56 days.

(21) Appl. No.: 15/731,045

(22) Filed: Apr. 12, 2017

(65) Prior Publication Data

US 2018/0295974 A1 Oct. 18, 2018

(51) Int. Cl.

| | |
|---|---|
| ***A45C 3/00*** | (2006.01) |
| ***A45C 7/00*** | (2006.01) |
| ***A45F 3/04*** | (2006.01) |
| ***A45F 3/06*** | (2006.01) |
| ***A45F 4/02*** | (2006.01) |
| ***F41H 1/00*** | (2006.01) |
| ***F41H 1/02*** | (2006.01) |
| ***F41H 5/00*** | (2006.01) |
| ***F41H 5/08*** | (2006.01) |
| ***A45C 13/10*** | (2006.01) |
| ***A45C 15/00*** | (2006.01) |

(52) U.S. Cl.

CPC ..... *A45F 4/02* (2013.01); *A45C 3/001* (2013.01); *A45C 7/0068* (2013.01); *A45C 13/103* (2013.01); *A45C 15/00* (2013.01); *A45F 3/04* (2013.01); *A45F 3/06* (2013.01); *F41H 1/02* (2013.01); *F41H 5/08* (2013.01); *F41H 1/00* (2013.01); *F41H 5/00* (2013.01)

(58) Field of Classification Search

CPC .... A45F 4/02; A45F 3/04; A45F 3/042; A45F 3/06; A45F 4/00; A45F 2004/023; A45C 7/0068; A45C 13/103; A45C 15/00; A45C 3/04; A45C 3/042; A41D 15/04; A41D 15/00; A41D 1/04; A41D 13/0015; A41D 13/05; A41D 13/0518

See application file for complete search history.

(56) References Cited

U.S. PATENT DOCUMENTS 3,381,306 A * 5/1968 Innes ..... A41D 15/00 2/69
5,031,733 A * 7/1991 Chang ..... A41D 15/04 190/1
5,165,111 A * 11/1992 Lieberman ..... A41D 15/04 2/108
5,586,703 A * 12/1996 Radar ..... A45F 3/04 224/148.2

(Continued)

*Primary Examiner* — Alissa J Tompkins
*Assistant Examiner* — Brieanna Szafran
(74) *Attorney, Agent, or Firm* — ATMAC Patent Services Ltd.; Andrew T. MacMillan

(57) ABSTRACT

A convertible bullet-proof backpack and vest includes a body section divided into a front portion, a middle portion, and back portion. The middle portion has a head slot opening, and the front and back portions have respective sections of bullet-proof fabric integrated therein. A zipper runs around an outer perimeter of the front and back portions. In a backpack configuration, the zipper secures the outer perimeters of the front portion and the back portion together thereby forming a hollow backpack interior between them. In a bullet-proof vest configuration, the zipper is unzipped thereby allowing a user to insert their head through the head slot opening such that the front portion hangs in front of a torso of the user and the back portion hangs behind the torso of the user.

18 Claims, 6 Drawing Sheets

(56) References Cited

U.S. PATENT DOCUMENTS 5,909,802 A * 6/1999 Puco ..... A45F 3/04 2/102
6,012,162 A * 1/2000 Bullat ..... A41D 13/018 2/2.5
6,014,772 A * 1/2000 Connelly ..... A41D 3/005 2/102
6,336,222 B1 * 1/2002 Ware ..... A41D 3/00 2/102
7,441,278 B2 * 10/2008 Blakeley ..... F41C 33/06 2/102
9,044,074 B1 * 6/2015 De Freitas ..... F41H 5/013
9,161,608 B2 * 10/2015 Achola ..... A45F 4/12
9,282,806 B2 * 3/2016 Vierthaler ..... A45F 3/10
9,596,921 B1 * 3/2017 Blanton ..... A45F 3/04
D792,678 S * 7/2017 Storlie ..... D2/825
9,820,558 B1 * 11/2017 de Geus ..... A45F 4/02
2003/0132260 A1 * 7/2003 Prather ..... A45C 15/00 224/576
2004/0060954 A1 * 4/2004 Hale ..... A45F 3/042 224/581
2004/0099704 A1 * 5/2004 Zion ..... A45F 3/08 224/576
2005/0194413 A1 * 9/2005 Baker ..... A45C 3/14 224/153
2007/0295772 A1 * 12/2007 Woodmansee ..... A45F 3/047 224/576
2012/0018477 A1 * 1/2012 Inouye ..... A45F 3/06 224/576
2012/0152991 A1 * 6/2012 Roane ..... A45C 7/0086 224/259
2012/0266344 A1 * 10/2012 Griffin ..... F41H 1/02 2/2.5
2013/0026726 A1 * 1/2013 Thomas ..... A45C 5/14 280/43.1
2014/0048575 A1 * 2/2014 Kennedy-Sharpe ..... A45C 3/00 224/637
2015/0144666 A1 * 5/2015 Rana ..... A45F 3/04 224/153
2015/0196077 A1 * 7/2015 McIntire, Jr. ..... A41D 15/04 2/2.5
2016/0238347 A1 * 8/2016 Blauer ..... F41H 1/02
2016/0360864 A1 * 12/2016 Drake ..... A41D 1/04
2017/0102214 A1 * 4/2017 Wright ..... F41H 1/02
2018/0317635 A1 * 11/2018 Quon-Chow ..... A45F 4/02

* cited by examiner

CONVERTIBLE BULLET-PROOF BACKPACK

FIELD OF THE INVENTION

The invention relates to the fields of backpacks and bullet-proof vests. More particularly, the invention relates to a backpack that is convertible into a bullet-proof vest and vice versa.

BACKGROUND OF THE INVENTION

We often hear news of gun fire in schools, universities and other public places around the world. If a stranger enters a building/area with weapons, students and teachers alike must take measures to protect themselves immediately from dangerous situations such as an open-fire, active shooter situation. Even though a bullet-proof vest serves great protection, most people don't wear bullet-proof vests in public or in private places, let alone students in university and school. Most students carry their objects and belongings in a backpack to school. However, a backpack is not the most ideal option for protection against heavy forces.

BRIEF SUMMARY OF THE INVENTION

This backpack is designed to bind both the backpack and bulletproof vest into one. Two bullet-proof fabric sheets are sewed inside the front and rear portion of the backpack. When in a risky situation, individuals can pull the zipper from the right to the left side, open the top zipper, then wear the backpack from head down to their waist, and fasten it. It only takes a very short time to convert the backpack into a bullet-proof vest.

This invention is designed to meet safety needs in schools, universities, offices, public areas, etc. The backpack comprises a front portion, rear portion and top portion connected by zippers. The bullet-proof fabrics are sewed inside the front portion and rear portion. The wearer can carry it as a daily use backpack. In emergency situations, the wearer can pull the zipper from the right to the left side, open the top zipper, then wear the backpack from head down to body, and fasten it. It takes a very short time to convert the backpack into a bullet-proof vest.

Bullet-proof fabrics are typically made of a woven fabric shell and have layers of anti-ballistic materials such as Kevlar® and Spectra®. Such bullet-proof fabrics are sewed inside the front portion and the rear portion of backpack body. The bullet-proof area covers the torso but does not cover the head, the arms, and the lower body.

The bullet-proof backpack weighs about 7-8 pounds before loading the wearer's belongings inside.

The wearer can load/unload items from the front side or the right side of the backpack.

A convertible bullet-proof backpack and vest disclosed herein includes a body section divided into a front portion, a middle portion, and back portion. The middle portion has a head slot opening, and the front and back portions have respective sections of bullet-proof fabric integrated therein. A zipper runs around an outer perimeter of the front and back portions. In a backpack configuration, the zipper secures the outer perimeters of the front portion and the back portion together thereby forming a hollow backpack interior between them. In a bullet-proof vest configuration, the zipper is unzipped thereby allowing a user to insert their head through the head slot opening such that the front portion hangs in front of a torso of the user and the back portion hangs behind the torso of the user.

BRIEF DESCRIPTION OF THE DRAWINGS

The invention will be better understood in light of the following description of the backpack according to the invention, given only by way of example, with reference to the annexed drawings, in which.

REFERENCE NUMERALS

| Numeral | Element |
|---|---|
| 10 | convertible bullet-proof backpack/vest |
| 12 | body section |
| 14 | front portion |
| 16 | back portion |
| 18 | middle portion |
| 20 | first zipper |
| 20a | first zipper chain (side of first zipper 20 on front portion 14) |
| 20b | second zipper chain (side of first zipper 20 on back portion 16) |
| 22 | top portion |
| 23 | rectangular joining section |
| 24 | head-slot opening |
| 26 | top zipper |
| 28 | additional first compartment |
| 30 | additional second compartment |
| 32 | additional third compartment |
| 34 | additional first compartment zipper |
| 36 | additional second compartment zipper |
| 38 | additional third compartment zipper |
| 40 | bullet proof fabrics in front portion |
| 42 | bullet proof fabrics in back portion |
| 44 | shoulder straps |
| 46 | adjustment buckles |
| 48 | loop strap |
| 50 | zipper slider and pull tab on first zipper |
| 52 | waist straps |
| 54 | buckles on waist straps |
| 56 | interior-facing surfaces of front and back portions |
| 58 | cloth covers |

DETAILED DESCRIPTION

Figure 1:
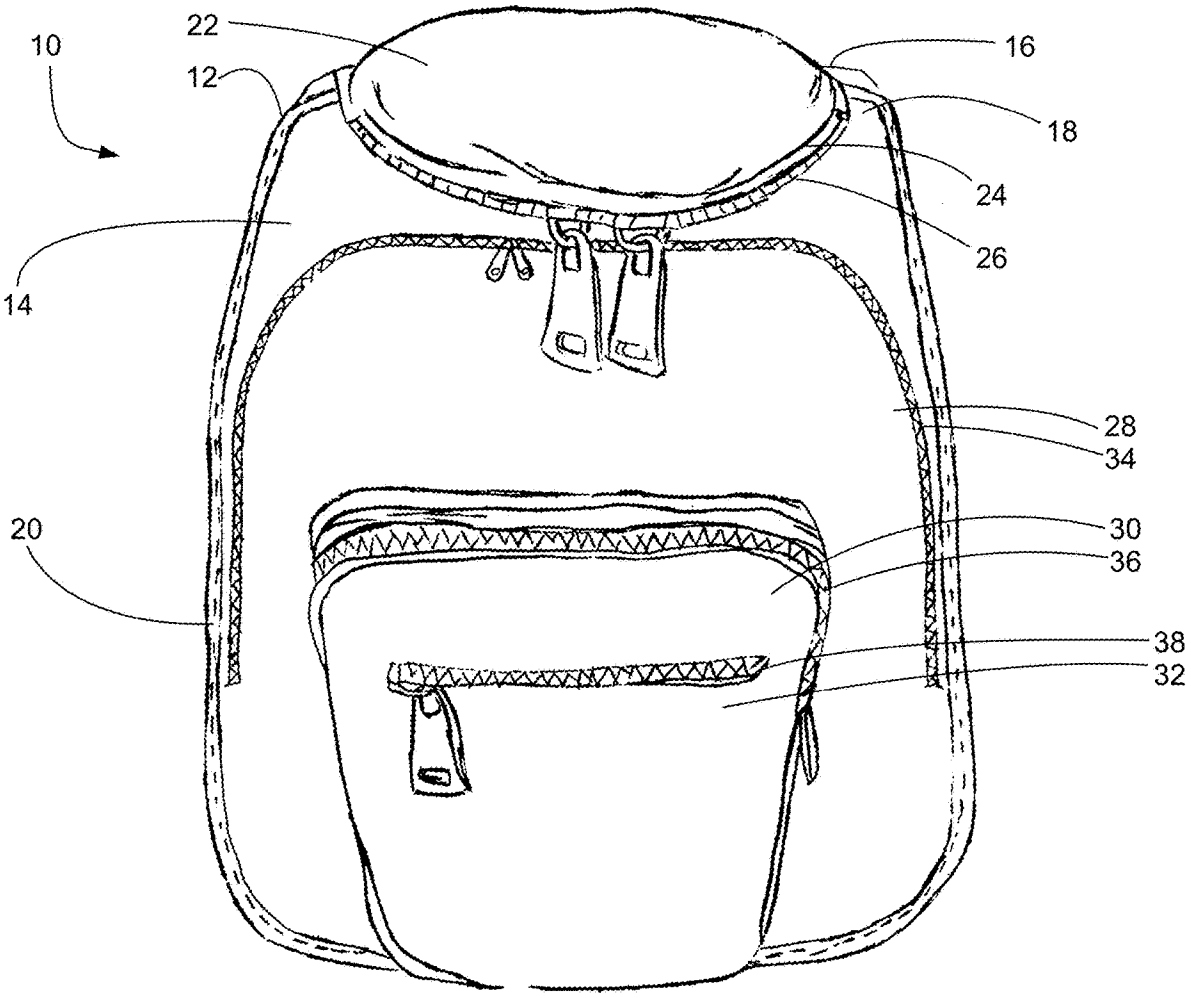
FIG. 1 is a front view of the backpack according to the invention.

FIG. 1 is a front view of a convertible bullet-proof backpack 10 in a backpack configuration according to the invention. The convertible bullet-proof backpack 10 includes a backpack body section 12 which has a front portion 14 and a back portion 16 connected on either side of a middle portion 18. The front portion 14 and the back portion 16 are attached to one another by a first zipper 20. The middle portion 18 includes a detachable top portion 22 that can close a head-slot opening 24 in the middle portion, and the top portion 22 is connected to the perimeter of the head-slot opening 24 by a top zipper 26.

When the first zipper 20 is closed as illustrated in FIG. 1, the front and back portions 14, 16 of the backpack body section 12 are joined together to form a backpack shape with an enclosed hollow interior that can be utilized for item storage just like a regular backpack. When the top zipper 26 is closed as illustrated in FIG. 1, the top portion 22 of the backpack 10 is also closed. Additional first, second, and third compartments 28, 30, 32 are provided on the outside of the front portion and can be accessed through additional zippers 34, 36, 38.

The backpack front portion 14 and back portion 16 have bullet-proof fabrics 40, 42 sewed inside. (Also see FIG. 6.) The bullet-proof fabric sheets 40, 42 are sewed inside the backpack 10, one on each of the front portion 14 and the back portion 16. The particular fabric is not constrained to just one material; preferred materials are nylon and aramids such as Kevlar®, Spectra®, etc.

Figure 2:
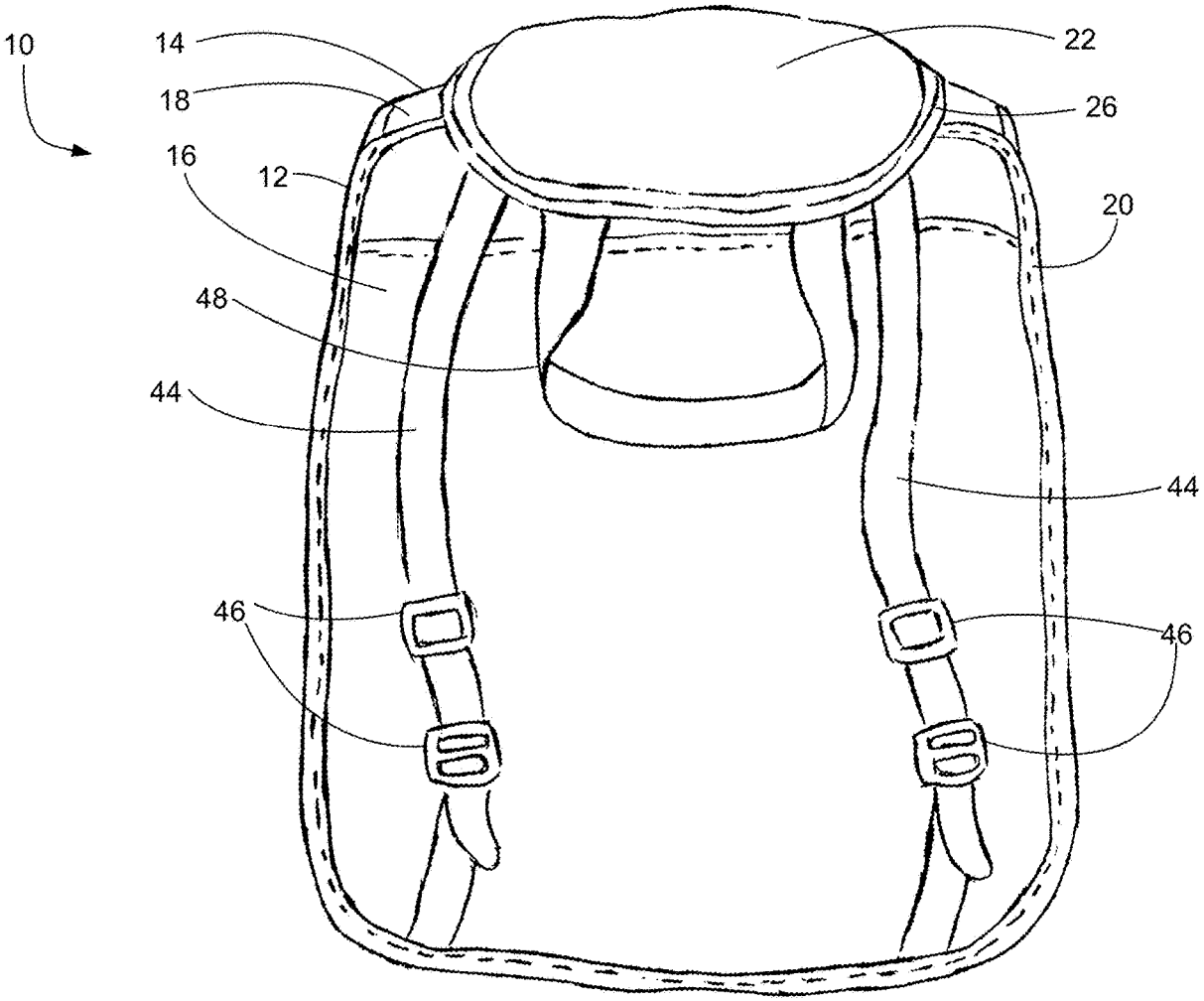
FIG. 2 is a rear view of the backpack.

FIG. 2 is a rear view of the backpack 10 of FIG. 1. As illustrated, the back portion 16 of the backpack body section 12 includes shoulder straps 44 for the user to wear the backpack 10. Adjustments buckles 46 are provided and allow size adjustments. A loop strap 48 is also provided to allow the backpack 10 to be hung on a hook for storage or to be carried by the user. The shoulder straps 46 and loop strap 48 are examples of carrying straps allowing the user to carry the backpack 10 when the backpack is in the backpack configuration.

Figure 3:
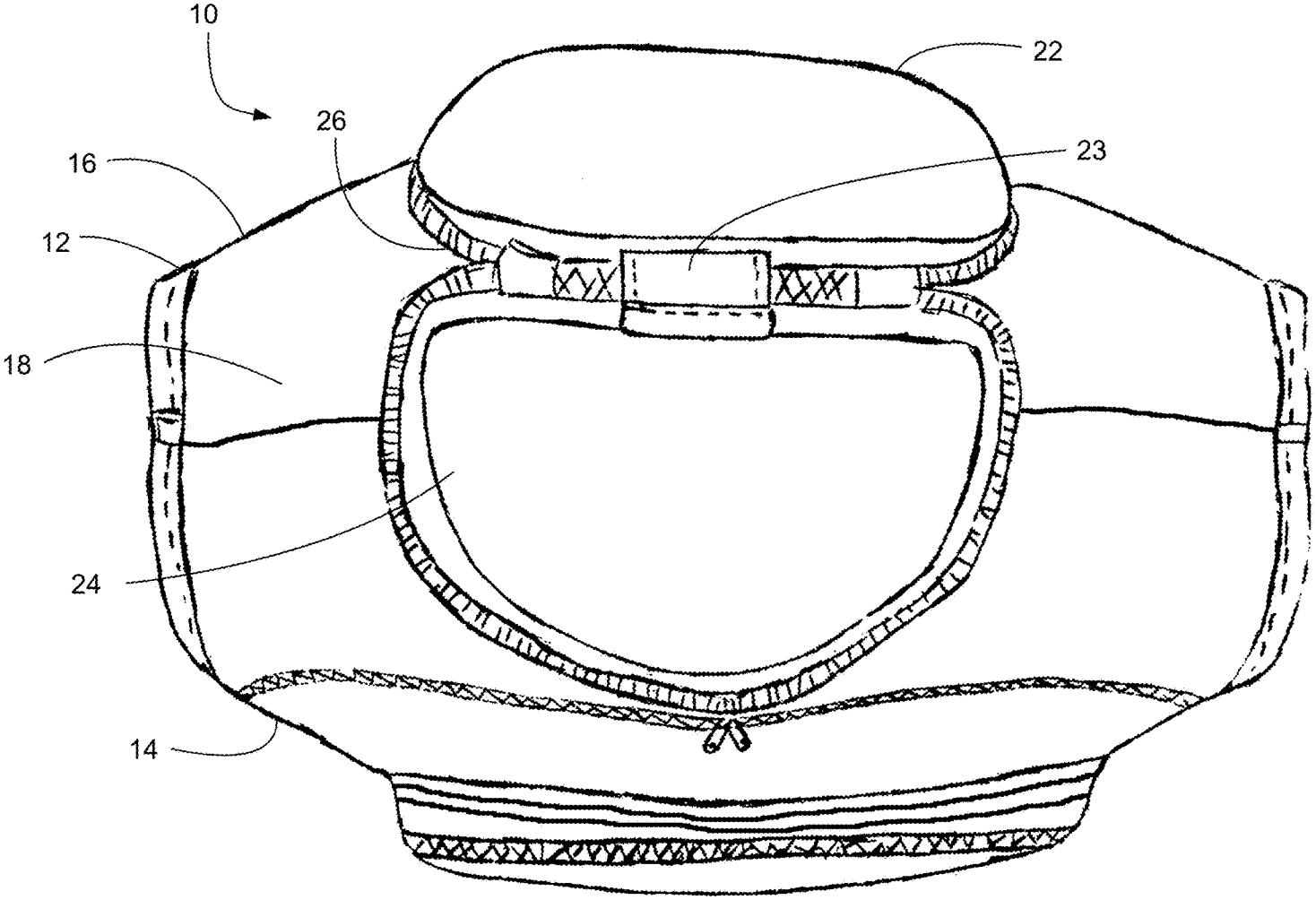
FIG. 3 is a top view of the backpack.

FIG. 3 is a top view of the backpack 10 of FIG. 1. As illustrated in FIG. 3, when the top zipper 26 is opened (i.e., unzipped), the detachable top portion 22 can be separated from the backpack body middle portion 18 and provides a head slot opening 24. In the backpack configuration, the head slot opening 24 can be utilized to access the hollow interior of the backpack 10. The top zipper 26 includes first and second chains that respectively extend around only a first part of a perimeter of the head slot opening 24 and the top portion 22. A second part of the perimeter of the head slot opening 24 and the top portion 22 are joined by a rectangular joining section 23.

Figure 4:
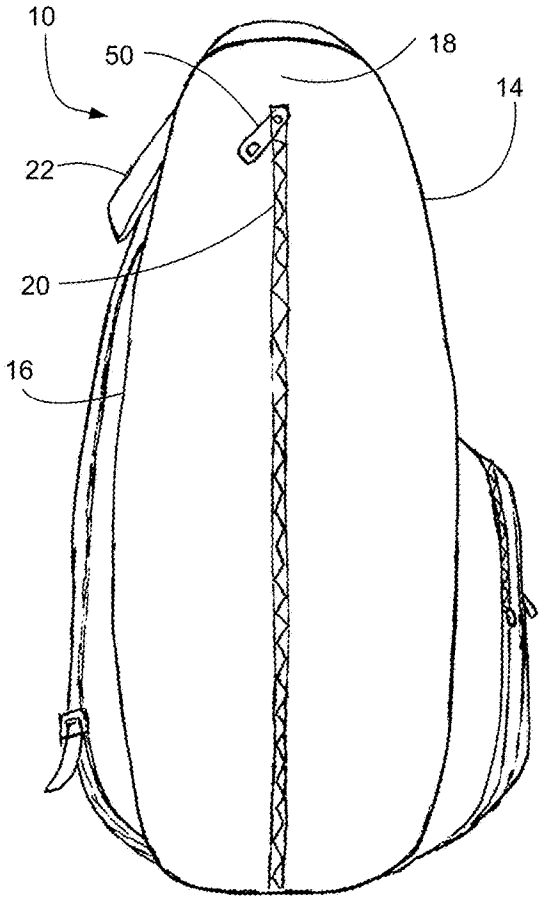
FIG. 4 is a first side view of the backpack in the zipped configuration.

FIG. 4 is a first side view of the backpack 10 while the first zipper 20 is zipped closed in the backpack configuration. The detachable top portion 22 is separated, folded opened and resting against the back portion 16 of the backpack body 12. A zipper slider 50 with pull tab is attached to the first zipper 20 and allows the user to join and unjoin the first zipper 20.

Figure 5:
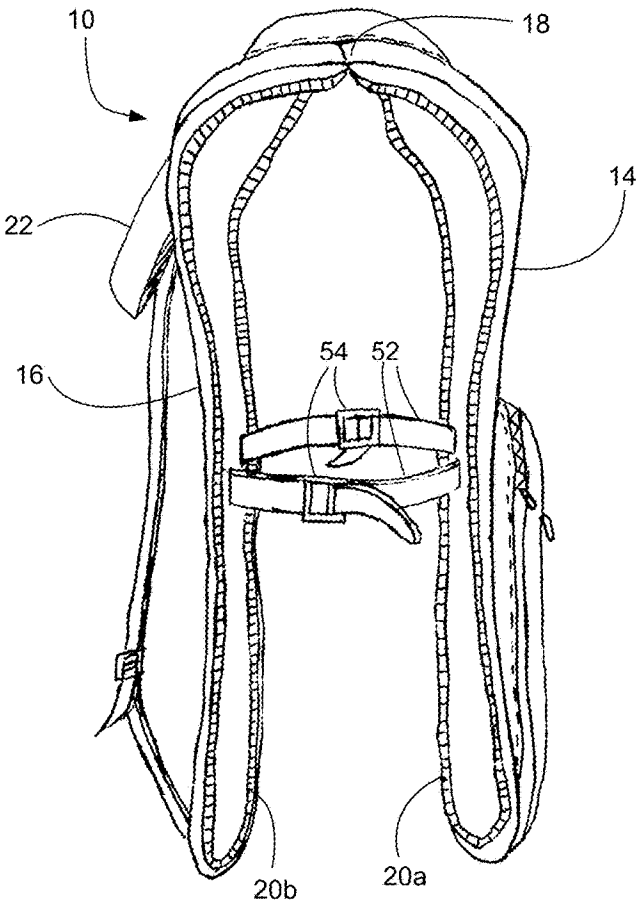
FIG. 5 is a second side view of the backpack in the unzipped configuration.

FIG. 5 is a second side view of the backpack 10 with the first zipper 20 unzipped in the bullet-proof vest configuration. With the first zipper 20 unzipped, waist straps 52 provided on the right and left interior sides are now accessible to the user. The waist straps 52 include buckles 54 allowing the user to fasten the front and back portions 14, 16 to the user's torso. The waist straps can be fastened on right and left side when a person wears the backpack in the bullet-proof vest configuration. A first zipper chain 20*a* being a first side of the zipper 20 runs around the outer perimeter of the front portion 14 and a second zipper chain 20*b* being the second side of the zipper 20 runs around the outer perimeter of the back portion 16.

Figure 6:
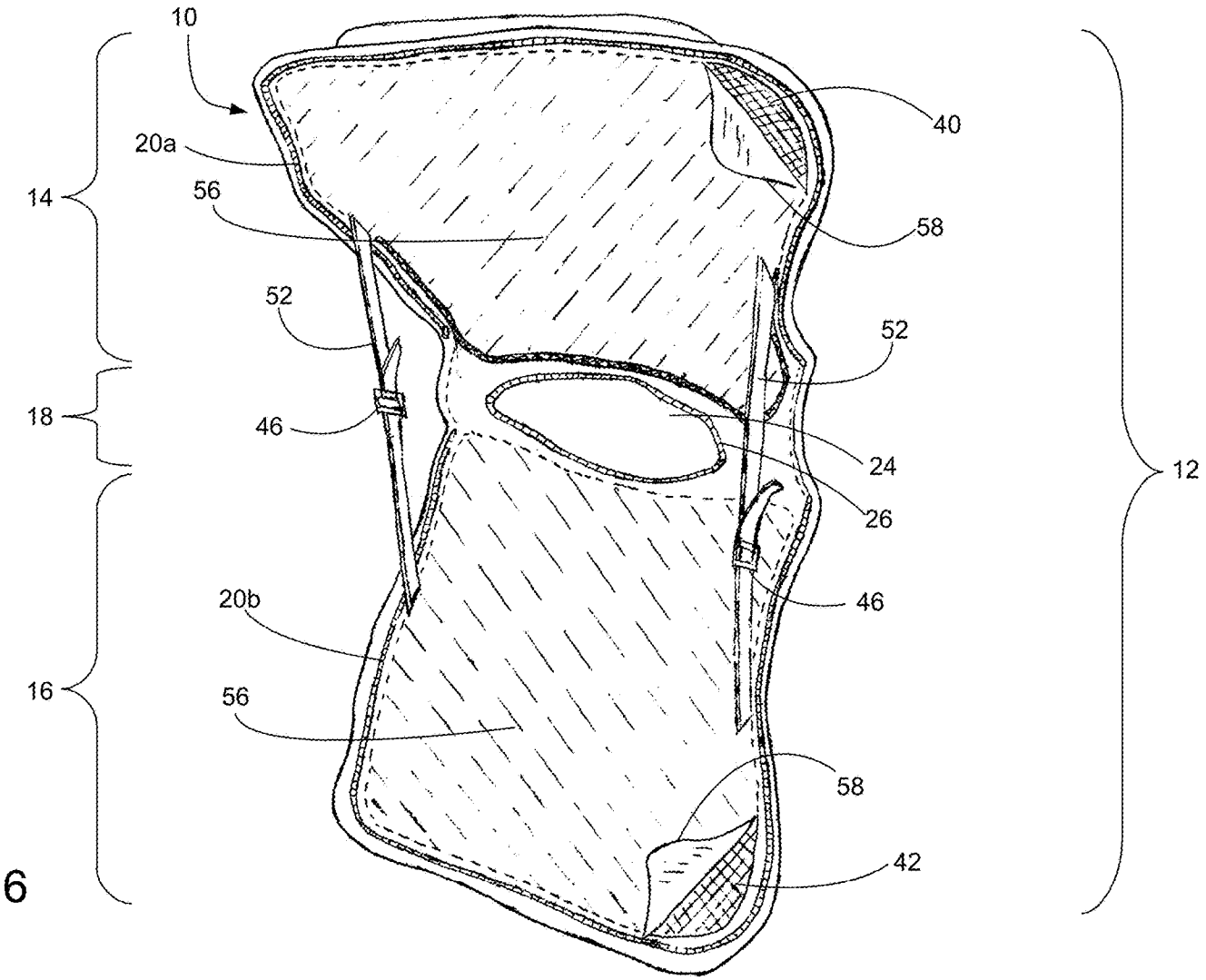
FIG. 6 is a inside view of the backpack.

FIG. 6 is an inside view of the backpack 10 when the first zipper 20 is completely unzipped and the backpack 10 is in the bullet-proof vest configuration. The backpack 10 is formed by an elongated body section 12 divided into the front portion 14 and the back portion 16 on opposite sides of a middle portion 18. An oval shaped detachable top portion 22 in the middle portion 18 is detached in FIG. 6 and its removal forms a head slot opening 24. The front and back portions 14, 16 of the body section 12 meet the middle portion 18 on either side of the head slot opening 24 such that the backpack's interior-facing surfaces 56 of the front and back portions 14, 16 face one another.

As illustrated, the backpack interior-facing surfaces 54, both on the front and back portions 14, 16, include cloth covers 58 over bullet-proof fabrics sections 40, 42. In particular, the front portion 14 has a first bullet-proof fabric section 40 sewn therein and the back portion 16 has a second bullet-proof fabric section 42 sewn therein. A first zipper chain 20*a* of the first zipper 20 runs around the three outer perimeter edges of the front portion 14 in a U-shape, and a second zipper chain 20*b* of the first zipper 20 runs around the three outside perimeter edges of the back portion 16 also in a U-shape. In other words, the first zipper chain 20*a* in the orientation shown in FIG. 6 appears as an upside-down U-shape and the second zipper chain 20*b* in FIG. 6 appears as a right-side-up U-shape. When the front and back portions 12, 14 are together in the backpack configuration, these U-shaped zipper chains 20*a*, 20*b* line up and form the first zipper 20 to be zipped and unzipped.

Figure 7:
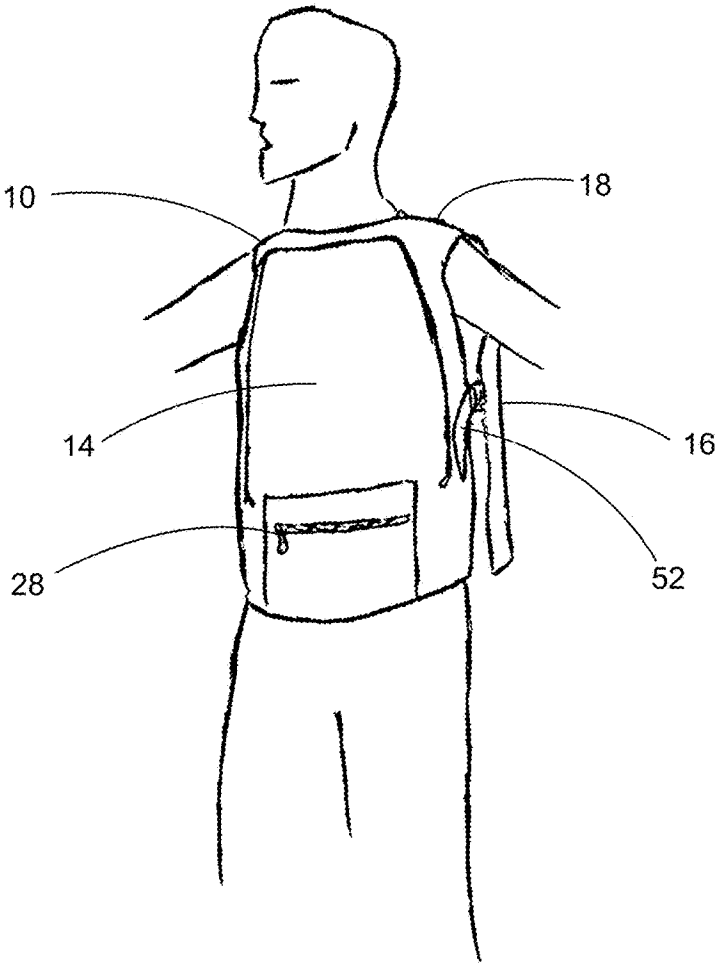
FIG. 7 is a front view demo of a user wearing the backpack.

In the vest configuration as illustrated in FIGS. 5-7, the two zipper chains 20*a*, 20*b* of the first zipper 20 are detached (i.e., zipper 20 is unzipped) and therefore the front portion 14 and the back portion 16 are only connected to each other via the middle portion 18 and the waist straps 52. The waist straps 52 are located about halfway down the backpack front backs portions 14, 16 on both the right and left sides, and include adjustment buckles 46. The two zipper chains 20*a*, 20*b* of the first zipper 20 attach to one another when the first zipper 20 is zipped up thereby converting the bullet-proof vest to the backpack configuration as shown in FIGS. 1-4.

FIG. 7 is a front view demo of a user wearing the backpack 10 in the bullet-proof vest configuration as illustrated in FIGS. 5-6. As illustrated, with the first zipper 20 unzipped and the backpack 10 in the bullet-proof vest configuration, the user puts their head through the head-slot opening 24. The body front portion 14 hangs down in front of the user's chest and the body back portion 16 hangs down behind the user's back. The middle portion 18 rests on the top of the user's shoulders. The user can utilize the waist straps 52 to tighten the front and back portions 14, 16 and hold them secure on either side of the user's body. The bullet-proof fabrics within the front and back portions 14, 16 provide protection for the user's torso both front and back. Any additional storage compartments 28 that are located on the outside of the front portion 14 of the backpack body 12 remain accessible to the user's hands when wearing the backpack 10 in the bullet-proof vest configuration.

When wearing the backpack 10 in the backpack configuration of FIGS. 1-4, the user can convert the backpack 10 to the bullet-proof vest configuration as follows. The user pulls the zipper slider 50 of the first zipper 20 to detach the front portion 14 from the back portion 16. The user opens the top zipper 26 to open the head-slot opening 24. The user wears the vest 10 by inserting their head through the head slot opening 24 such that the front portion 14 hangs in front of the torso of the user and the back portion 16 hangs behind the torso of the user. The user then tightens the adjustable waist straps 52.

For simplicity or efficiency, the invention can be created in the absence of any additional element that is not specifically disclosed herein.

The invention claimed is:

1. A convertible bullet-proof backpack comprising:

a backpack configuration and a bullet-proof vest configuration;

a body section of the bullet-proof backpack including a front portion, a middle portion, and a back portion;

the front portion of the body section located on a first side of the middle portion, the front portion having a first section of bullet-proof fabric integrated therein;

the back portion of the body section located on a second side of the middle portion, the second side being on an opposite side of the middle portion than the first side, the back portion having a second section of bullet-proof fabric integrated therein;

the middle portion of the body section extending between the front portion and the back portion, the middle portion having a slot opening provided therein configured to receive a user's head in the bullet-proof vest configuration and a detachable top portion of the middle portion for allowing the user to close the slot opening in the backpack configuration;

the body section further comprising a first zipper chain and a second zipper chain of a zipper configured to close the backpack in the backpack configuration, the first zipper chain provided in a first U-shape around an outer perimeter of the front portion, the second zipper chain provided in a second U-shape around an outer perimeter of the back portion, a zipper slider on at least one of the first zipper chain and the second zipper chain:

wherein, in the backpack configuration, the front portion and the back portion are moved towards each other and connected at the middle portion so that the first zipper chain and the second zipper chain are attached to one another thereby securing the outer perimeters of the front portion and the back portion together closing sides and a bottom portion of the backpack and thereby forming a hollow backpack interior between the front portion and the back portion; and in the bullet-proof vest configuration, the first zipper chain and the second zipper chain are detached from one another thereby allowing the user to adaptively insert their head through the slot opening of the middle portion and adaptively extend their arms between the first and second zipper chains such that the front portion is configured to hang in front of a torso of the user and the back portion is configured to hang behind the torso of the user.

2. The convertible bullet-proof backpack of claim 1, wherein the back portion further includes one or more carrying straps on an exterior-facing side.

3. The convertible bullet-proof backpack of claim 1, further comprising a plurality of adjustable waist straps for securing the front portion and the back portion to each other adaptively around the torso of the user in the bullet-proof vest configuration.

4. The convertible bullet-proof backpack of claim 3, wherein the plurality of adjustable waist straps are connected to interior-facing sides of the front portion and the back portion such that the plurality of adjustable waist straps are enclosed within the hollow backpack interior in the backpack configuration.

5. The convertible bullet-proof backpack of claim 3, wherein the plurality of adjustable waist straps include adjustment buckles.

6. The convertible bullet-proof backpack of claim 1, further comprising an additional storage compartment accessible from an exterior-facing side of the front portion.

7. The convertible bullet-proof backpack of claim 1, further comprising a cloth cover on interior-facing sides of the front portion and the back portion.

8. The convertible bullet-proof backpack of claim 1, wherein the detachable top portion is attached within the slot opening by a top zipper on the middle portion.

9. The convertible bullet-proof backpack of claim 8, wherein the top zipper of the middle portion includes first and second chains that respectively extend around a first part of a perimeter of the slot opening and the detachable top portion, wherein a second part of the perimeter of the slot opening and the detachable top portion are joined such that the detachable top portion is configured to extend backwards on the back portion of the body section when the top zipper is unzipped.

10. A method of converting the convertible bullet-proof backpack of claim 8 from the backpack configuration to the bullet-proof vest configuration, the method comprising:

pulling the zipper slider to detach the front portion from the back portion;

opening the top zipper of the middle portion to open the slot opening;

inserting a head of the user through the slot opening such that the front portion hangs in front of the torso of the user and the back portion hangs behind the torso of the user; and tightening one or more adjustable waist straps.

11. A convertible bullet-proof vest comprising:

a backpack configuration and a bullet-proof vest configuration;

a body section of the bullet-proof vest including a front portion, a middle portion, and a back portion;

the front portion of the body section located on a first side of the middle portion, the front portion having a first section of bullet-proof fabric integrated therein;

the back portion of the body section located on a second side of the middle portion, the second side being on an opposite side of the middle portion than the first side, the back portion having a second section of bullet-proof fabric integrated therein;

the middle portion of the body section extending between the front portion and the back portion, the middle portion having a slot opening provided therein configured to receive a user's head in the bullet-proof vest configuration and a detachable top portion of the middle portion for allowing the user to close the slot opening in the backpack configuration;

the body section further comprising a first zipper chain and a second zipper chain of a zipper configured to close the backpack in the backpack configuration, the first zipper chain provided in a first U-shape around an outer perimeter of the front portion, the second zipper chain provided in a second U-shape around an outer perimeter of the back portion, a zipper slider on at least one of the first zipper chain and the second zipper chain:

wherein, in the backpack configuration, the front portion and the back portion are moved towards each other and connected at the middle portion so that the first zipper chain and the second zipper chain are attached to one another thereby securing the outer perimeters of the front portion and the back portion together closing sides and a bottom portion of the backpack and thereby forming a hollow backpack interior between the front portion and the back portion; and in the bullet-proof vest configuration, the first zipper chain and the second zipper chain are detached from one another thereby allowing the user to adaptively insert their head through the slot opening of the middle portion and adaptively extend their arms between the first and second zipper chains such that the front portion is configured to hang in front of a torso of the user and the back portion is configured to hang behind the torso of the user.

12. The convertible bullet-proof vest of claim 11, wherein the back portion further includes one or more carrying straps on an exterior-facing side.

13. The convertible bullet-proof vest of claim 11, further comprising a plurality of adjustable waist straps for securing the front portion and the back portion to each other adaptively around the torso of the user in the bullet-proof vest configuration.

14. The convertible bullet-proof vest of claim 13, wherein the plurality of adjustable waist straps are connected to interior-facing sides of the front portion and the back portion such that the plurality of adjustable waist straps are enclosed within the hollow backpack interior in the backpack configuration.

15. The convertible bullet-proof vest of claim 13, wherein the plurality of adjustable waist straps include adjustment buckles.

16. The convertible bullet-proof vest of claim 11, further comprising a cloth cover on interior-facing sides of the front portion and the back portion.

17. The convertible bullet-proof vest of claim 11, wherein the detachable top portion is attached within the slot opening by a top zipper on the middle portion.

18. A method of converting the convertible bullet-proof vest of claim 17 from the backpack configuration to the bullet-proof vest configuration, the method comprising:

pulling the zipper slider to detach the front portion from the back portion;

opening the top zipper of the middle portion to open the slot opening;

inserting a head of the user through the slot opening such that the front portion hangs in front of the torso of the user and the back portion hangs behind the torso of the user; and tightening one or more adjustable waist straps.

* * * * *